US011466935B2

(12) United States Patent
Park et al.

(10) Patent No.: US 11,466,935 B2
(45) Date of Patent: Oct. 11, 2022

(54) SYSTEMS AND METHODS FOR ALTERING MICROSTRUCTURES OF MATERIALS

(71) Applicant: General Electric Company, Schenectady, NY (US)

(72) Inventors: Junyoung Park, Greer, SC (US); Ibrahim Ucok, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 316 days.

(21) Appl. No.: 16/739,659

(22) Filed: Jan. 10, 2020

(65) Prior Publication Data

US 2021/0214826 A1 Jul. 15, 2021

(51) Int. Cl.
*F27D 11/12* (2006.01)
*C22F 3/02* (2006.01)
(Continued)

(52) U.S. Cl.
CPC ..... *F27D 11/12* (2013.01); *C21D 1/04* (2013.01); *C22F 3/02* (2013.01); *C22F 1/002* (2013.01); *F27D 19/00* (2013.01)

(58) Field of Classification Search
CPC . F27D 11/12; F27D 19/00; C21D 1/04; C22F 3/02; C22F 1/002
(Continued)

(56) References Cited

U.S. PATENT DOCUMENTS 3,188,248 A * 6/1965 Bassett, III ..... C21D 1/04 148/108
4,465,526 A * 8/1984 Watanabe ..... C22C 5/04 148/306
(Continued)

OTHER PUBLICATIONS

Joo et al., "An Effect of a Strong Magnetic Field on the Phase Transformation in Plain Carbon Steels", Metallurgical and Materials Transactions A, Jun. 2004, vol. 35A, pp. 1663-1668.
(Continued)

*Primary Examiner* — Steven B McAllister
*Assistant Examiner* — Benjamin W Johnson
(74) *Attorney, Agent, or Firm* — James Pemrick; Charlotte Wilson; Hoffman Warnick LLC

(57) ABSTRACT

Systems and methods for altering microstructures of materials are disclosed. The system may include at least one computing device in communication with a heating device and an electromagnetic device. The computing device(s) may be configured to alter a microstructure of a material forming a component by performing processes including heating the component using the heating device to a predetermined temperature. The predetermined temperature may be below a first phase-transformation temperature based on the material forming the component, and a second phase-transformation temperature based on the material forming the component, where the second phase-transformation temperature greater than the first phase-transformation temperature. The computing device(s) may also perform processes including intermittently magnetizing the heated component using the electromagnetic device for a predetermined number of cycles, and cooling the component after intermittently magnetizing the heated component.

17 Claims, 10 Drawing Sheets

(51) Int. Cl.
*C21D 1/04* (2006.01)
*C22F 1/00* (2006.01)
*F27D 19/00* (2006.01)

(58) Field of Classification Search
USPC ..... 432/52
See application file for complete search history.

(56) References Cited

U.S. PATENT DOCUMENTS

| | | | | |
|---|---|---|---|---|
| 5,492,572 | A * | 2/1996 | Schroeder | G01D 5/249 219/121.17 |
| 2006/0231549 | A1* | 10/2006 | Kisner | H05B 6/105 219/635 |
| 2008/0178971 | A1* | 7/2008 | Hattiangadi | C21D 5/00 148/612 |
| 2012/0125486 | A1* | 5/2012 | Garcin | C21D 1/04 148/218 |

OTHER PUBLICATIONS

Smallman et al., "Delta Iron Phase Diagrams and Alloy Theory", Science Direct in Modern Physical Metallurgy (Eighth Edition), 2014, 20 Pages.
Ballentine, "Iron-Iron Carbide Phase Diagram Example", Materials Science and Metallurgy (4th Edition), 1998, 3 Pages.

* cited by examiner

SYSTEMS AND METHODS FOR ALTERING MICROSTRUCTURES OF MATERIALS

BACKGROUND

The disclosure relates generally to processing materials, and more particularly, to systems and methods for altering microstructures of materials.

Many industries work to improve the physical and/or compositional properties of materials forming components or parts to improve operations and/or reduce required maintenance on those parts and/or the systems or devices that use the parts. For example, as the efficiencies of turbine systems used to generate a load or power are improved, it is desired to improve the operational efficiencies and/or operational life of the components included within the turbine system. As such, the formation of these parts have improved and/or have required additional steps to improve physical and/or compositional properties of materials forming the part. Parts formed from metal materials may undergo thermal processes prior to implementing the part for its desired function, and/or performing finishing processes (e.g., smoothing) on the part. The thermal processes may include heat treating the part to change or modify the compositional properties (e.g., microstructures) of the material forming the part. More specifically, when the material is heated the microstructures of the metal material may be changed or modified, which in turn changes the physical and/or compositional properties of materials.

During conventional processes, the thermal processes performed on the metal material may increase the hardness and/or strength of the material when compared to the material prior to performing the thermal processes. While the strength of the part is increased, the thermal process performed on the material may result in less desirable changes in the microstructure of the materials. For example, metal materials that may undergo the thermal processes may have increased strength, but may have a decrease in material ductility. As a result, and based on conventional processes, the material forming the component is forced to trade one desirable characteristic (e.g., ductility) for another (e.g., strength).

Furthermore, because conventional processes involve just heating a part, control of the effects of the process are also hard to control, which often results in undesirable outcomes within the part. For example, when the material is used to form a large and/or a substantially dense part, there may be discrepancies in the microstructures of the part itself. That is, conventional thermal processes performed on the part may not be able to uniformly heat the entirety of the part—especially when the part is large and/or substantially dense or solid. As a result, conventional parts having undergone conventional thermal processes may have distinct physical and/or compositional properties between outer portions of the part (e.g., portions positioned adjacent and/or forming an outer surface) and inner portions of the part (e.g., portions positioned adjacent the core and/or internal from the outer surface). This may be a direct result of the heat being unable to penetrate into the inner portion as well and/or for as long as the outer portion. As such, conventional parts may have stronger/harder outer portions, while having more ductile inner portions—which often results in undesired results (e.g., breakage).

Additionally, conventional thermal processes performed on the parts make it difficult to control the change or modification to the microstructures of the parts. That is, conventional thermal processes sometimes do not allow for the ability to modify and/or control the process such that the microstructure of the material includes a desired change in physical and/or compositional properties. Additionally, conventional thermal processes to change the microstructures in materials takes a long time to achieve desired results, making the production of parts having changed physical and/or compositional properties a long, and difficult process.

SUMMARY

A first aspect of the disclosure provides a system, including: at least one computing device in communication with a heating device and an electromagnetic device, the at least one computing device configured to alter a microstructure of a material forming a component by performing processes including: heating the component using the heating device to a predetermined temperature within a first phase field of the material, the predetermined temperature below: a first phase-transformation temperature based on the material forming the component, the first phase-transformation temperature defining a second phase field of the material, distinct from the first phase field, and a second phase-transformation temperature based on the material forming the component, the second phase-transformation temperature greater than the first phase-transformation temperature and defining a third phase field of the material, distinct from the first phase field and the second phase field, intermittently magnetizing the heated component using the electromagnetic device for a predetermined number of cycles; and cooling the component after intermittently magnetizing the heated component.

A second aspect of the disclosure provides a method of altering a microstructure of a material forming a component. The method including: heating the component using a heating device to a predetermined temperature within a first phase field of the material, the predetermined temperature below: a first phase-transformation temperature based on the material forming the component, the first phase-transformation temperature defining a second phase field of the material, distinct from the first phase field, and a second phase-transformation temperature based on the material forming the component, the second phase-transformation temperature greater than the first phase-transformation temperature and defining a third phase field of the material, distinct from the first phase field and the second phase field, intermittently magnetizing the heated component using an electromagnetic device for a predetermined number of cycles; and cooling the component after intermittently magnetizing the heated component.

The illustrative aspects of the present disclosure are designed to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure it will become necessary to select certain terminology when referring to and describing relevant machine components within a gas turbine system and/or combined cycle power plants. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

As indicated above, the disclosure relates generally to processing materials, and more particularly, to systems and methods for altering microstructures of materials.

These and other embodiments are discussed below with reference to FIGS. 1-10. However, those skilled in the art will readily appreciate that the detailed description given herein with respect to these figures is for explanatory purposes only and should not be construed as limiting.

Figure 1:
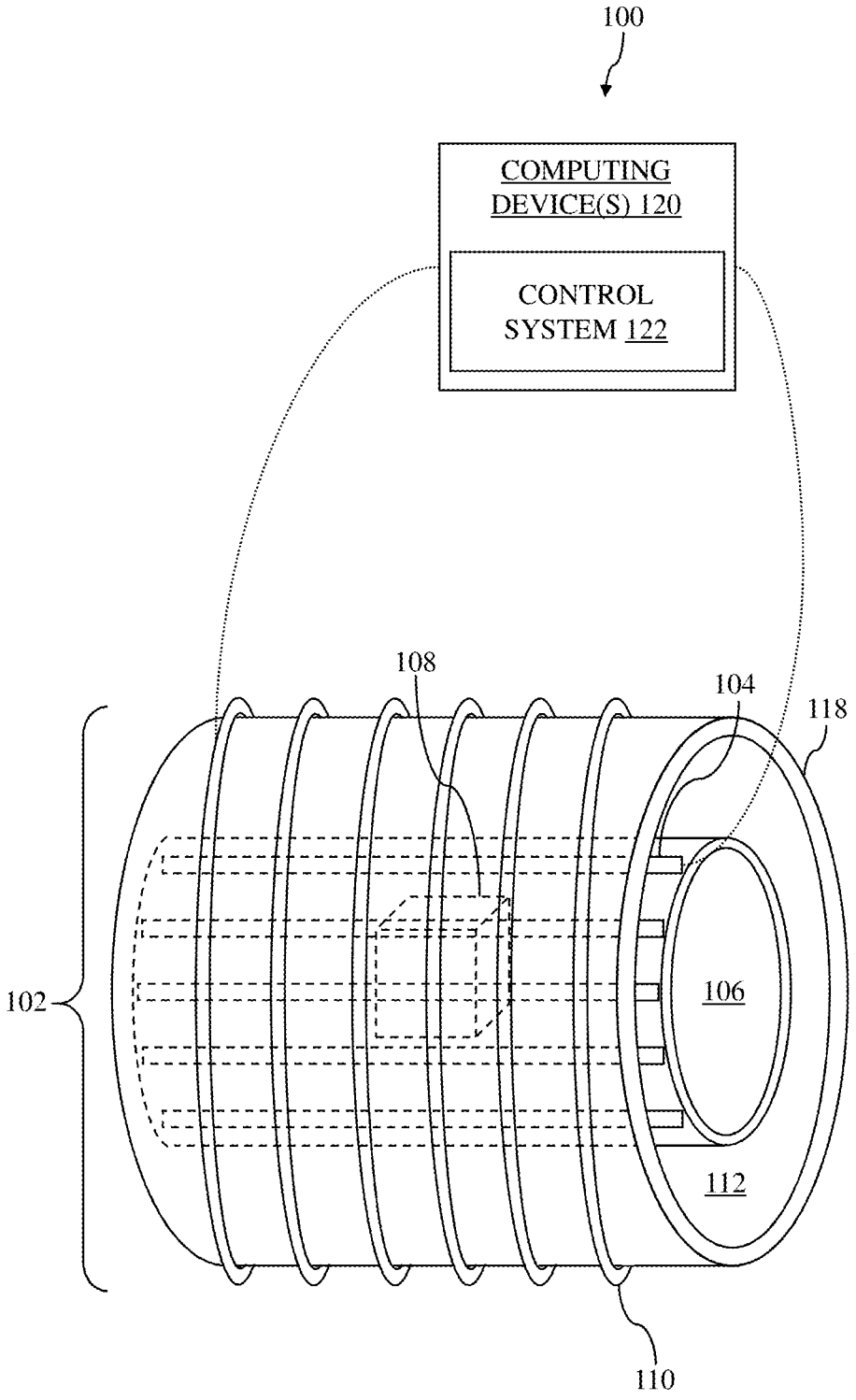
FIG. 1 shows a schematic depiction of a material processing system including an apparatus, and at least one computing device, according to embodiments of the disclosure.

FIG. 1 shows a schematic view of a material processing system 100 according to various embodiments of the disclosure. As discussed herein, material processing system 100 (hereafter, "system 100") may include various apparatuses, devices, and/or components configured to alter microstructures of a material used to form a component. For example, system 100 may include apparatus 102. As discussed herein, apparatus 102 may be formed as any suitable combination of devices and/or assemblies that may be configured to perform the material altering processes discussed herein. As shown in FIG. 1, apparatus 102 may include a heating device 104. Heating device 104 may include a chamber 106 which may be configured to receive and/or support component 108 during the microstructure altering process discussed herein. In the non-limiting example shown in FIG. 1, heating device 104 may be formed as Silicone Carbide (SiC) heating elements that may substantially surround chamber 106 and/or component 108 to heat component 108 when positioned within chamber 106. In other non-limiting examples, heating device 104 may include various material heating elements or coils, a furnace, a sealed chamber in communication with an external heating system (e.g., gaseous heater, electric resistance heater), and/or any other suitable device or assembly that may be configured to heat component 108.

Apparatus 102 may also include an electromagnetic device 110. Electromagnetic device 110 may be positioned adjacent heating device 104 of apparatus 102. In the non-limiting example shown in FIG. 1, electromagnetic device 110 may substantially surround heating device 104, and may be separated and/or spaced apart from heating device 104. As such, a gap or space 112 may be formed between heating device 104 receiving component 108 and electromagnetic device 110. Electromagnetic device 110 of apparatus 102 for system 100 may be configured to provide, generate, and/or apply an electromagnetic field to, toward, and/or to surround component 108 positioned within heating device 104. The electromagnetic field applied or generated by electromagnetic device 110 may magnetize component 108 during the microstructure altering process discussed herein. In the non-limiting example, electromagnetic device 110 may be formed as a coil that may substantially surround and may magnetize component 108 positioned within heating device 104. However, it is understood that electromagnetic device 110 may be formed from any suitable device and/or assembly that may be configured to magnetize component 108 positioned within heating device 104 during the microstructure altering process discussed herein.

Apparatus 102 of system 100 may also include a heat shield 118. Heat shield 118 may be positioned between electromagnetic device 110 and heating device 104. In the non-limiting example shown in FIG. 1, heat shield 118 may be positioned within and/or may at least partially define space 112 formed between separated heating device 104 and electromagnetic device 110. Additionally, and as shown in FIG. 1, electromagnetic device 110 formed as a coil may be positioned on and/or may be substantially supported by heat shield 118. Where electromagnetic device 110 substantially surrounds heating device 104, heat shield 118 may also substantially surround heating device 104, between electromagnetic device 110 and heating device 104. Heat shield 118 may be formed as any suitable device that may be configured to absorb heat generated from heating device 104, and/or shield electromagnetic device 110 from being exposed to the heat generated by heating device 104 during the process discussed herein. For example, heat shield 118 may be formed as a conduit, a wrap, or a collection of fins positioned around heating device 104. Additionally, heat shield 118 may be formed from any suitable material that may be configured to absorb and/or block the heat generated by heating device 104, as well as allow electromagnetic fields generated by electromagnetic device 110 to pass through heat shield 118 to magnetize component 108. For example, heat shield 118 may be formed from refractory materials such as, but not limited to, solid ceramic materials, ceramic-based materials, oxide/oxide-mixtures, nitrides, alumina paper/sheets, Fiberfrax®, polymer or polymer-based material, fiberglass, or similar materials including similar thermal/electromagnetic penetrative properties.

As shown in FIG. 1, material processing system 100 can include at least one computing device 120 configured to control apparatus 102. Computing device(s) 120 can be hard-wired and/or wirelessly connected to and/or in communication with apparatus 102, and its various components (e.g., heating device 104, electromagnetic device 110, and so on) via any suitable electronic and/or mechanic communication component or technique. Computing device(s) 120, and its various components discussed herein, may be a single stand-alone system that functions separate from another power plant control system (e.g., computing device) (not shown) that may control and/or adjust operations and/or functions of apparatus 102, and its various components (e.g., heating device 104, electromagnetic device 110, and so on). Alternatively, computing device(s) 120 and its components may be integrally formed within, in communication with and/or formed as a part of a larger power plant control system (e.g., computing device)(not shown) that may control and/or adjust operations and/or functions of apparatus 102, and its various components (e.g., heating device 104, electromagnetic device 110, and so on).

In the non-limiting example, computing device(s) 120 can include a control system 122, as described herein, for controlling operations of apparatus 102. More specifically, control system 122 can control apparatus 102, and its various components, to alter the microstructure of component 108 positioned within apparatus 102, and undergoing the altering process discussed herein.

Figure 2:
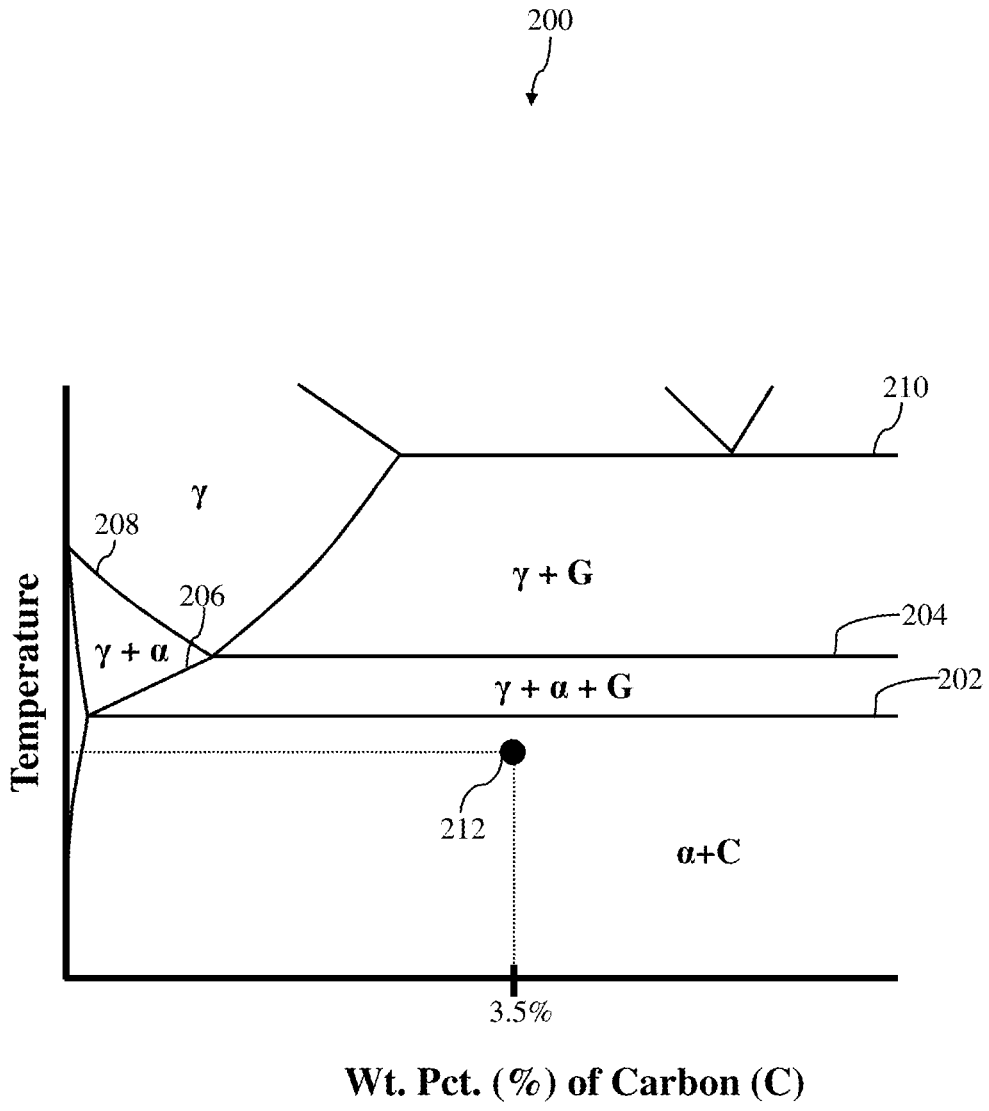
FIG. 2 shows a phase diagram for a material forming a component undergoing a portion of a microstructure alteration process, according to embodiments of the disclosure.

FIG. 2 shows a phase diagram 200 for a material forming component 108 processed by system 100 of FIG. 1. In a non-limiting example shown in FIG. 2, phase diagram 200 may represent a phase diagram for iron (Fe) or iron-based materials. Although discussed herein with reference to phase diagram 200 representative of iron (Fe) based material (e.g., "material"), it is understood that the processes for altering the microstructure may be performed on distinct materials forming component 108 that may include similar material characteristics and/or properties, and/or may undergo material phase shifts based on exposure to heat and/or electromagnetic forces. For example, ferromagnetic or ferrous materials such as steel, iron-alloys, cast irons, and other such materials may undergo similar processes as those discussed herein with respect to the iron (Fe) based material forming component 108.

In the non-limiting example, phase diagram 200 may provide a graphical representation of the different phases or phase fields for the material (e.g., iron (Fe) based material) forming component 108. More specifically, phase diagram 200 may depict the various phase fields for the material and define the temperatures in which the material may shift or change between phase fields. For example, phase diagram 200 may include a first or lower phase-transformation temperature 202 that may be represented by a substantially horizontal line in diagram 200. First phase-transformation temperature 202 may define and/or separate two distinct phase fields for the material. That is, and as shown in FIG. 2, first phase-transformation temperature 202 may separate a first or alpha+cementite ($\alpha$+C) phase field of the material and a second or gamma+alpha+graphite ($\gamma$+$\alpha$+G) phase field of the material. As such, first phase-transformation temperature 202 may also at least partially define first phase field ($\alpha$+C) and second phase field ($\gamma$+$\alpha$+G) in phase diagram 200. First phase-transformation temperature 202 may corresponded to a known, predefined, and/or calculable temperature and may be dependent on the weight percentage of an element, for example silicon, found in the material represented in phase diagram 200.

Additionally, phase diagram 200 may include a second or upper phase-transformation temperature 204 that may be represented by another substantially horizontal line in diagram 200. As shown in FIG. 2, second phase-transformation temperature 204 may be distinct and greater/higher than first phase-transformation temperature 202. Second phase-transformation temperature 204 may define and/or separate two other phase fields for the material. More specifically, and as shown in the non-limiting example, second phase-transformation temperature 204 may separate a second phase field ($\gamma$+$\alpha$+G) of the material and a third or gamma+graphite ($\gamma$+G) phase field of the material represented in phase diagram 200. As such, second phase-transformation temperature 204 may also at least partially define second phase field ($\gamma$+$\alpha$+G) and third phase field ($\gamma$+G) in phase diagram 200. Similar to first phase-transformation temperature 202, second phase-transformation temperature 204 may corresponded to a known, predefined, and/or calculable temperature and may be dependent on the weight percentage of an element, for example silicon, found in the material represented in phase diagram 200.

As shown in FIG. 2, phase diagram 200 may include a plurality of other phase-transformation temperatures 206, 208, 210 that are represented by distinct lines. The other phase-transformation temperatures 206, 208, 210 (and respective lines) may also define distinct phase fields (e.g., gamma+alpha ($\gamma$+$\alpha$), gamma ($\gamma$)) for the material represented within phase diagram 200. As is understood, the identified phase fields (e.g., $\alpha$, $\gamma$+$\alpha$+G, $\gamma$+G, $\gamma$+$\alpha$, and so on) in phase diagram 200 may represent the elements and/or compositional portions of the material that may be stable when the material is at or heated to the respective temperatures. When, for example, the material is heated and/or the temperature of the material is elevated from one phase field to a distinct phase field volume fraction may occur, and/or the size of the phases would change due to phase-transformation, as discussed herein.

Turning back to FIG. 1, and with reference to FIGS. 2-4, a process of altering microstructure of material forming component 108 will now be discussed. As discussed herein, the non-limiting example material forming component 108 may include iron (Fe) based material. However, it is understood that system 100 may perform the process on a variety of distinct materials to alter the microstructure of each material.

In the processes for altering microstructures of the iron (Fe) based material forming component 108, component 108 may first be heated to a predetermined temperature 212. Predetermined temperature 212 may be based or dependent on, at least in part, the known composition of the material forming component 108. For example, and as shown in FIG. 2, the iron (Fe) based material forming component 108 (see, FIG. 1) may include 3.5%, by weight, of carbon (C) therein. Based on the percentage of silicon and other alloying elements present in the iron (Fe) based material, the predetermined temperature 212 in which component 108 may be heated to may be set, determined, calculated, and/or known. Additionally, or alternatively, predetermined temperature 212 may be dependent, at least in part, on phase diagram 200 for the material forming component 108. More specifically, predetermined temperature 212 may be dependent on phase-transformation temperatures 202, 204, 206, 208, 210 associated with and/or defining each of the phase fields represented within phase diagram 200. In the non-limiting example, predetermined temperature 212 for the iron (Fe) based material forming component 108 may be within the first phase field (α+C) identified in phase diagram 200. As a result, and as shown in FIG. 2, predetermined temperature 212 may be below and/or lower than both first phase-transformation temperature 202 and second phase-transformation temperature 204 for the iron (Fe) based material including 3.5%, by weight, of carbon (C). As discussed herein, component 108 may be heated to predetermined temperature 212 using heating device 104 of apparatus 102 for system 100, as shown in FIG. 1.

Once component 108 is heated to predetermined temperature 212 within the first phase field (α+C), component 108 may be maintained at predetermined temperature 212 while performing additional processes thereon. For example, and as discussed herein, once component 108 is heated to predetermined temperature 212, the temperature of component 108 may be maintained at predetermined temperature 212 while component 108 is intermittently magnetized. Additionally as discussed herein, heated component 108 may be magnetized using electromagnetic device 110 of apparatus 102 for system 100, as shown in FIG. 1.

Figure 3:
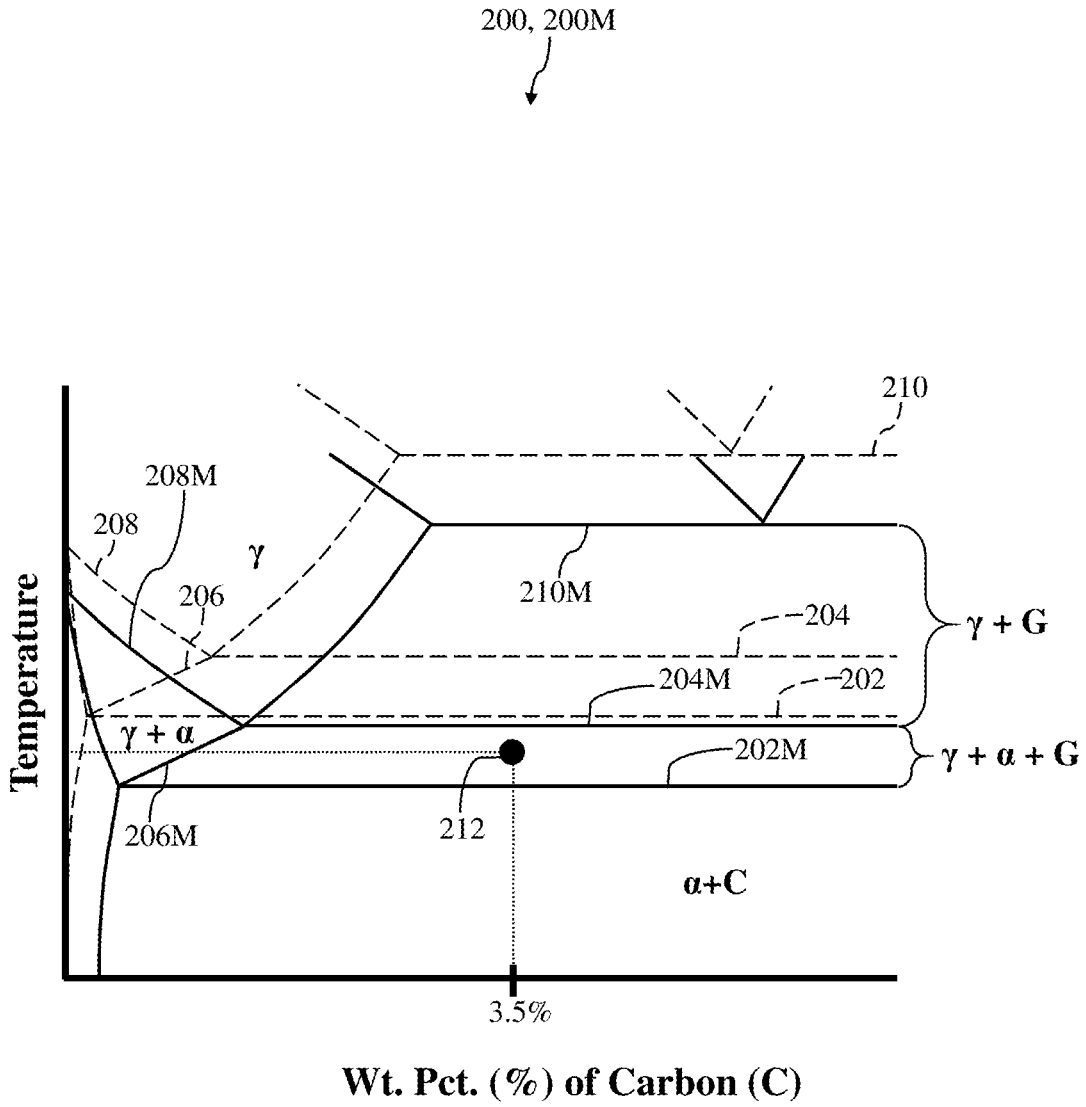
FIG. 3 shows a shifted phase diagram for the material forming the component undergoing a distinct portion of a microstructure alteration process, according to embodiments of the disclosure.

Turning to FIG. 3, overlaying phase diagram 200 and shifted phase diagram 200M are shown for the iron (Fe) based material forming component 108. That is, phase diagram 200 (shown in phantom) including phase-transformation temperatures 202, 204, 206, 208, 210 (shown in phantom) may provide the graphical representation of the different phases or phase fields for the iron (Fe) based material forming component 108, when component 108 is not magnetized. Phase diagram 200 shown in phantom in FIG. 3 may be identical to phase diagram 200 shown in FIG. 2.

Shifted phase diagram 200M shown in FIG. 3 may show a graphical representation of the different phases or phase fields for the iron (Fe) based material forming component 108, when component 108 is magnetized (e.g., via electromagnetic device 110—FIG. 1). As discussed herein, electromagnetic device 110 may intermittently magnetize component 108 for a predetermined number of cycles during the process for altering the microstructure of the iron (Fe) based material forming component 108. When component 108 is magnetized and/or surrounded by the electromagnetic field applied or generated by electromagnetic device 110, shifted phase diagram 200M, and the different phases or phase fields depicted thereon may be adjusted and/or altered. More specifically, the application of an electromagnetic field to the iron (Fe) based material forming component 108 may lower, reduce, and/or shift down the various phase-transformation temperatures 202M, 204M, 206M, 208M, 210M. As shown in FIG. 3, first phase-transformation temperature 202 (shown in phantom) may be reduced and/or may shift diagonally (e.g., down and to the right) in phase diagram 200M to a reduced, first phase-transformation temperature 202M when component 108 is magnetized. Additionally, second phase-transformation temperature 204 (shown in phantom) may be reduced and/or may shift diagonally (e.g., down and to the right) in phase diagram 200M to a reduced, second phase-transformation temperature 204M when component 108 is magnetized. In the non-limiting example shown in FIG. 3, reduced, second phase-transformation temperature 204M when component 108 is magnetized may be lower than first phase-transformation temperature 202 (shown in phantom) when component 108 is not magnetized. As a result of lower phase-transformation temperatures 202M, 204M, 206M, 208M, 210M in shifted phase diagram 200M when component 108 is magnetized, all phase fields for the iron (Fe) based material, as defined by phase-transformation temperatures 202M, 204M, 206M, 208M, 210M, may also be lowered and/or reduced.

The material forming component 108 (e.g., iron) may be intermittently magnetized for a predetermined number of cycles during the process for altering the microstructure of the iron (Fe) based material forming component 108. More specifically, electromagnetic device 110 may intermittently magnetize component 108 by applying an electromagnetic field to component 108 for a predetermined time and/or at a predetermined electromagnetic strength for each of the predetermined number of cycles. The predetermined number of cycles, the predetermined time of each cycle, and/or the predetermined electromagnetic strength may be based, at least in part, on the material forming component 108. For example, the predetermined number of cycles, the predetermined time of each cycle, and/or the predetermined electromagnetic strength may be determined based on the composition and/or properties (e.g., weight percentage of silicon) of the material forming component 108. Determining, calculating, and/or identifying the predetermined number of cycles, time of each cycle, and/or electromagnetic strength, along with the predetermined temperature, may determine, affect, and/or impact the alteration to the microstructure of the material forming component 108. That is, and as discussed herein, the predetermined number of cycles, the predetermined time of each cycle, and/or the predetermined electromagnetic strength, in combination with the predetermined temperature for heated component 108, may determine or define the alteration of the microstructure for component 108. As such, adjusting the predetermined number of cycles, time of each cycle, electromagnetic strength, and/or predetermined temperature may improve the ability to control the alterations and/or changes of the microstructure for the material forming component 108. In the non-limiting example discussed herein where component 108 is formed from iron (Fe) based material, adjusting the predetermined number of cycles, time of each cycle, electromagnetic strength, and/or predetermined temperature may alter and/or change the ratio of pearlite and ferrite present in component 108, once the process is complete.

The time of each cycle may be at least approximately equal in each of the cycles, or alternatively may vary from cycle-to-cycle. For example, the time of each cycle may increase, decrease, or follow a predetermined pattern when applying the electromagnetic field to component 108. For example, the time of each cycle may increase, decrease, or follow a predetermined pattern when applying the electromagnetic field to component 108. Similarly, the electromagnetic strength for the electromagnetic field applied to component 108 may be constant or the same in each of the cycles, or alternatively may vary from cycle-to-cycle. For example, the electromagnetic strength of the applied electromagnetic field in each cycle may increase, decrease, or follow a predetermined pattern when applying the electromagnetic field to component 108. Additionally, the electromagnetic strength may vary within each cycle. That is, in a single cycle of the plurality of predetermined cycles, the electromagnetic strength of the applied electromagnetic field may vary and/or fluctuate.

When intermittently magnetizing component 108, predetermined temperature 212 of component 108 may be maintained. More specifically, regardless of whether component 108 is magnetized (e.g., FIG. 3) or de-magnetized (e.g., FIG. 2), component 108 may remain heated to predetermined temperature 212 until the final predetermined cycle of magnetization is completed on component 108. In the non-limiting example shown in FIG. 3, maintained, predetermined temperature 212 of component 108 may be greater than reduced, first phase-transformation temperature 202M when applying the electromagnetic field to component 108 and/or magnetizing the (iron) material forming component 108. Additionally in the non-limiting example, maintained, predetermined temperature 212 of component 108 may still be less than reduced, second phase-transformation temperature 204M when applying the electromagnetic field to component 108 and/or magnetizing the (iron) material forming component 108. As a result of being greater than reduced, first phase-transformation temperature 202M, component 108 heated and maintained at predetermined temperature 212 may also change phase fields when magnetized. With reference to FIG. 3, when component 108 is magnetized, the material forming component 108 may be shifted from the first phase field ($\alpha$+C) (see, FIG. 2) to the second phase field ($\gamma$+$\alpha$+G) in shifted phase diagram 200M defined, at least in part, by reduced, first phase-transformation temperature 202M.

As discussed herein, component 108 may be intermittently magnetized to alter the microstructure of the material forming component 108. That is, the electromagnetic field applied to component 108 to reduce first phase-transformation temperature 202 to reduced, first phase-transformation temperature 202M may be intermittently applied such that the material forming component 108 may shift between phase diagram 200 of FIG. 2, and shifted phase diagram 200M of FIG. 3. As a result of intermittently magnetizing (e.g., magnetizing and de-magnetizing) component 108, and in the non-limiting example shown between FIGS. 2 and 3, component 108 may also shift between first phase field ($\alpha$+C) when de-magnetized (see, FIG. 2) and second phase field ($\gamma$+$\alpha$+G) when magnetized. As discussed herein, component 108 may shift between first phase field ($\alpha$+C) and second phase field ($\gamma$+$\alpha$+G) as a result of the material forming component 108 being heated to and maintained at predetermined temperature 212 while first phase-transformation temperature 202 is reduced and/or returned based on the intermittent magnetization of component 108.

Once component 108 has been intermittently magnetized by electromagnetic device 110 (see, FIG. 1) for the predetermined number of cycles, component 108 may be cooled. More specifically, component 108 maintained at predetermined temperature 212 may be cooled and/or may no longer be heated to and/or maintained at predetermined temperature 212 using heating device 104 (see, FIG. 1). In a non-limiting example, component 108 may be cooled by discontinuing the heat applied to component 108 via heating device 104. As a result, the temperature of component 108 may be reduced to a desired temperature (e.g., room temperature) by a natural process, air cooling, and/or without additional aid. In other non-limiting examples, component 108 may be cooled using additional aids and/or processes. For example, the component 108 may be air quenched, submerged in a cooling bath, or may be sprayed with nitrogen to rapidly cool and/or decrease the temperature of component 108 from predetermined temperature 212 to the desired temperature. The desired cooling temperature may be predetermined and/or based on post or additional processes that may be performed on component 108 undergoing the processes discussed herein, and/or may be dependent on the function, operation, and/or intended use of component 108.

Additionally, after or during the cooling process, component 108 may also be demagnetized. Specifically, component 108 undergoing the heating and magnetization process may be demagnetized after the predetermined number of cycles of electromagnetic field have been applied. Demagnetizing component 108 may include removing and/or altering the magnetic field and/or polarization that component 108 inherited and/or gained during the process discussed herein. Demagnetizing component 108 may be performed using any suitable device and/or system that may apply a different/reverse polarized magnitude to the part and/or remove the magnetization from component 108

It is understood that the predetermined number of cycles, the predetermined time for applying the electromagnetic field, the predetermined electromagnetic strength of the applied electromagnetic field, and/or predetermined temperature 212 of component 108 may determine how the material of component 108 is altered. That is, each of these operational parameters may determine, dictate, control, and/or affect how the microstructure of the material forming component 108 may be adjusted and/or altered after performing the processes discussed herein. For example, where the material forming component 108 is an iron (Fe)-base material, the predetermined time/electromagnetic strength/number of cycles/temperature of component 108 may alter and/or change the ratio of pearlite and ferrite present in component 108. As such, the alteration to the microstructure of component 108 may be controlled.

Figure 4:
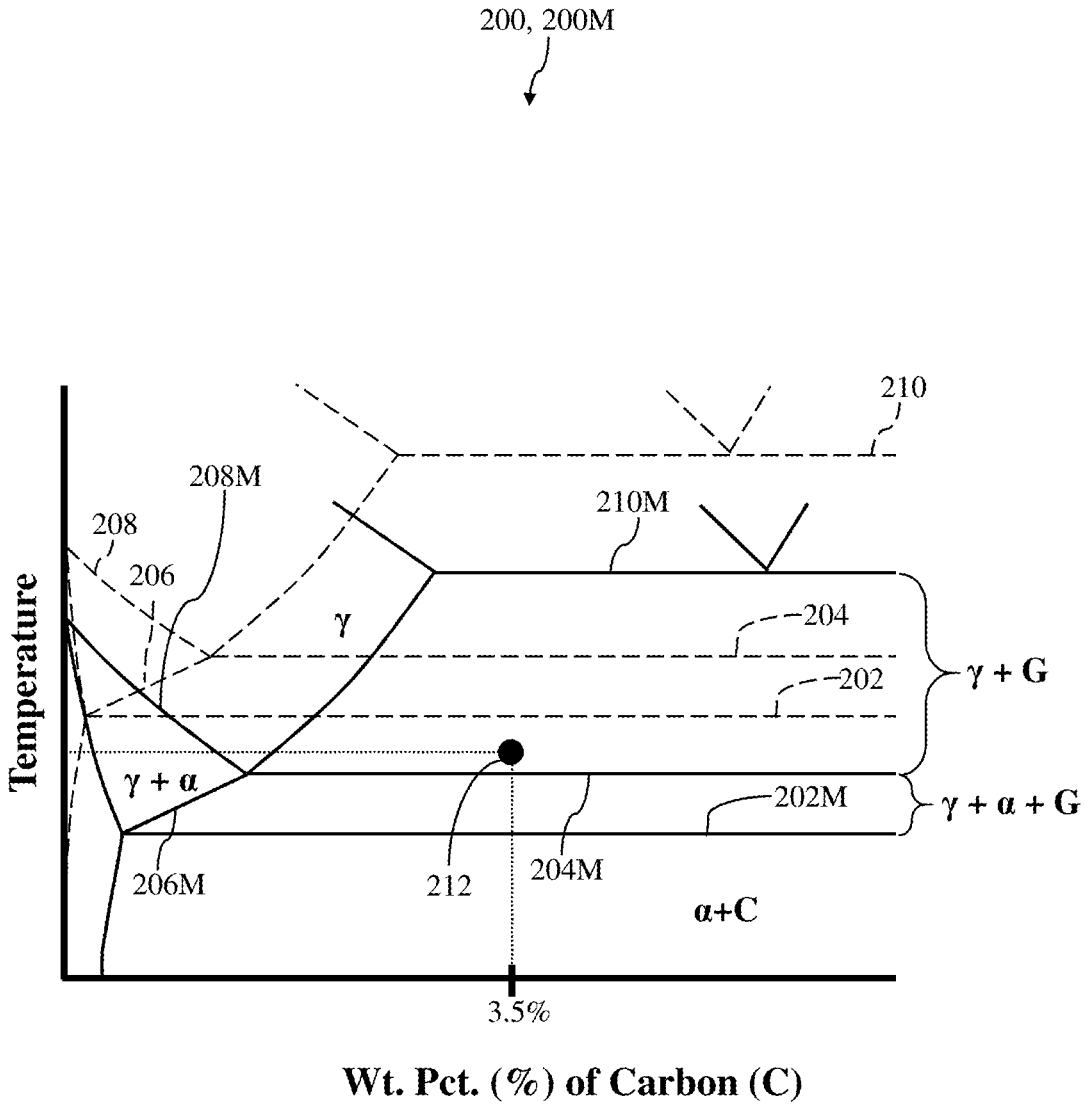
FIG. 4 shows a shifted phase diagram for a material forming a component undergoing another microstructure alteration process, according to additional embodiments of the disclosure.

Turning to FIG. 4, another non-limiting example of phase diagram 200, and shifted phase diagram 200M are shown. As similarly discussed herein with respect to FIG. 3, first phase-transformation temperature 202 and second phase-transformation temperature 204 (shown in phantom) may be reduced and/or may shift diagonally (e.g., down and to the right) in phase diagram 200M to reduced, first phase-transformation temperature 202M and reduced, second phase-transformation temperature 204M when component 108 is magnetized. Distinct from the non-limiting example shown in FIG. 3, maintained, predetermined temperature 212 of component 108 may be greater than both reduced, first phase-transformation temperature 202M and reduced, second phase-transformation temperature 204M when applying the electromagnetic field to component 108 and/or magnetizing the (iron) material forming component 108, as shown in FIG. 4. As a result of being greater than reduced, first phase-transformation temperature 202M and reduced, second phase-transformation temperature 204M, component 108 heated and maintained at predetermined temperature 212 may also change or shift phase fields when magnetized. With reference to FIG. 4, when component 108 is magnetized, the material forming component 108 may be shifted from the first phase field ($\alpha$+C) (see, FIG. 2) to the third phase field ($\gamma$+G) in shifted phase diagram 200M defined, at least in part, by reduced, second phase-transformation temperature 204M.

The non-limiting example in FIG. 4 may represent a process for altering the microstructure of component 108 where the predetermined number of cycles, the predetermined time for applying the electromagnetic field, and/or the predetermined electromagnetic strength may be distinct (e.g., greater) than the same operational specifics of the process discussed herein with respect to FIGS. 2 and 3. In another non-limiting example, the shifted phase diagram 200M shown in FIG. 4 may represent a distinct cycle in the same process of altering the microstructure of component 108 as those discussed herein with respect to FIGS. 2 and 3. That is, shifted phase diagram 200M shown in FIG. 3 may represent the results of a first cycle of magnetizing component 108, while shifted phase diagram 200M shown in FIG. 4 may represent the results of a second/distinct cycle of magnetizing component 108. As discussed herein, the distinction in the change in first phase-transformation temperature 202M and second phase-transformation temperature 204M and/or the distinction in the phase field shift between FIGS. 3 and 4 may be based in part on the predetermined time for applying the electromagnetic field, and/or the predetermined electromagnetic strength.

Figure 5:
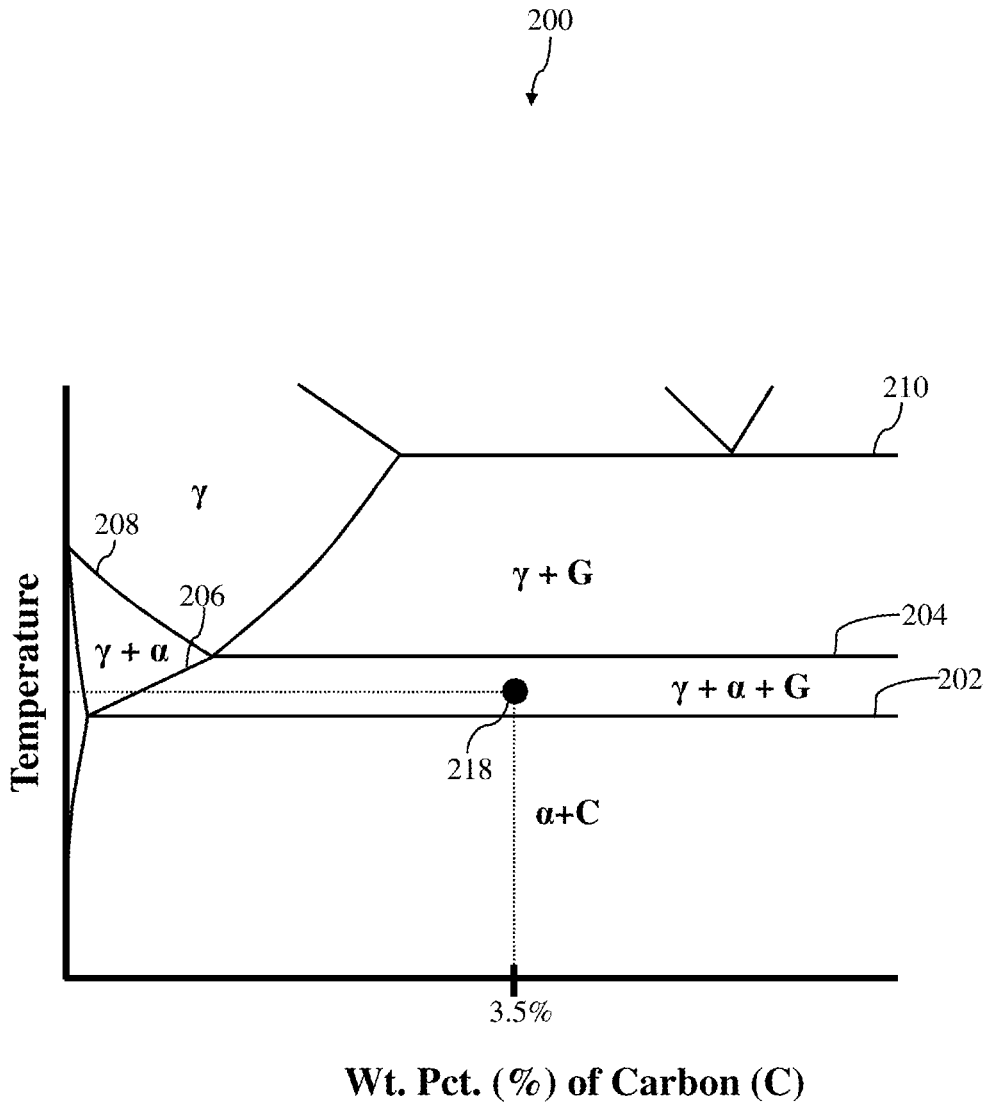
FIG. 5 shows a phase diagram for a material forming a component undergoing a portion of a microstructure alteration process, according to additional embodiments of the disclosure.
Figure 6:
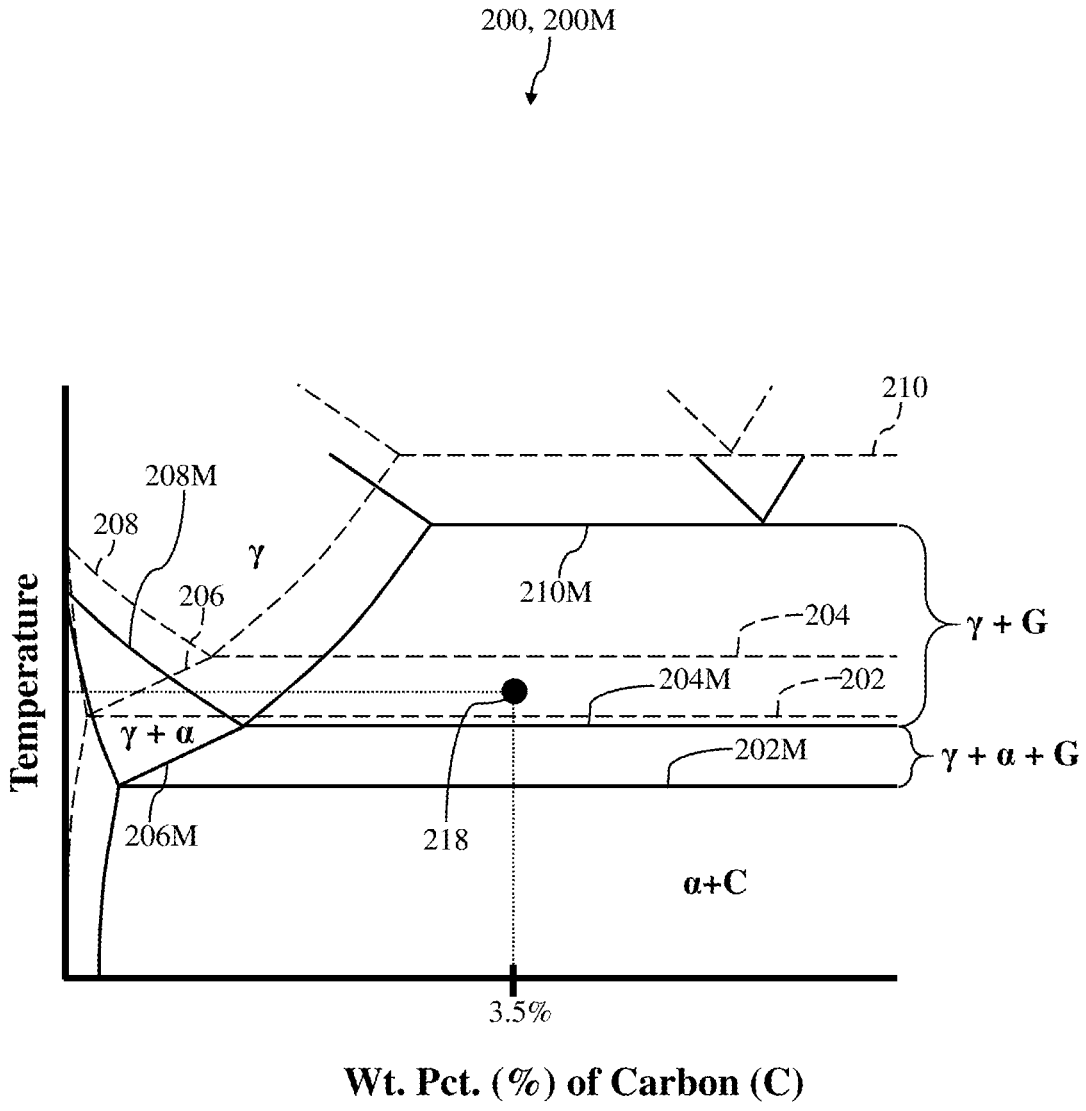
FIG. 6 shows a shifted phase diagram for the material forming the component undergoing a distinct portion of a microstructure alteration process, according to additional embodiments of the disclosure.

FIGS. 5 and 6 show an additional, non-limiting example of phase diagram 200 (FIG. 5) and shifted phase diagram 200M for a component 108 (see, FIG. 1) undergoing similar microstructure alternation process, as discussed herein with respect to FIGS. 1-4. It is to be understood that similarly numbered and/or named components may function in a substantially similar fashion. Redundant explanation of these components has been omitted for clarity.

Distinct from the non-limiting examples discussed herein with respect to FIGS. 1-4 however, the microstructure alternation process shown in FIGS. 5 and 6 may include some distinctions. For example, and with comparison to FIGS. 2-4, component 108 may have a distinct predetermined temperature 218. That is, component 108 undergoing the microstructure alternation process shown in FIGS. 5 and 6 may be heated to a higher and/or elevated predetermined temperature 218 than predetermined temperature 212 discussed herein. In the non-limiting example, predetermined temperature 218 for component 108 may be within the second phase field ($\gamma+\alpha+G$) identified in phase diagram 200. More specifically, predetermined temperature 218 for component 108 undergoing the microstructure alternation processes discussed herein may place the material forming component 108 in the second phase field ($\gamma+\alpha+G$) after heating component 108, and prior to applying an electromagnetic field to component 108 (see, FIG. 6). As a result, and as shown in FIG. 5, predetermined temperature 218 may be above first phase-transformation temperature 202, but below second phase-transformation temperature 204.

Once component 108 is heated to predetermined temperature 218, component 108 may be intermittently magnetized, as discussed herein. Turning to FIG. 6, and similarly discussed herein with respect to FIGS. 3 and 4, first phase-transformation temperature 202 and second phase-transformation temperature 204 (shown in phantom) may be reduced and/or may shift diagonally (e.g., down and to the right) in phase diagram 200M to reduced, first phase-transformation temperature 202M and reduced, second phase-transformation temperature 204M when component 108 is magnetized. In the non-limiting example shown in FIG. 6, maintained, predetermined temperature 218 of component 108 may be greater than both reduced, first phase-transformation temperature 202M and reduced, second phase-transformation temperature 204M when applying the electromagnetic field to component 108 and/or magnetizing the material forming component 108. As a result of being greater than reduced, first phase-transformation temperature 202M and reduced, second phase-transformation temperature 204M, component 108 heated and maintained at predetermined temperature 218 may also change or shift phase fields when magnetized. With reference to FIG. 6, when component 108 is magnetized, the material forming component 108 may be shifted from the second phase field ($\gamma+\alpha+G$) (see, FIG. 5) to the third phase field ($\gamma+G$) in shifted phase diagram 200M defined, at least in part, by reduced, second phase-transformation temperature 204M.

Figure 7A:
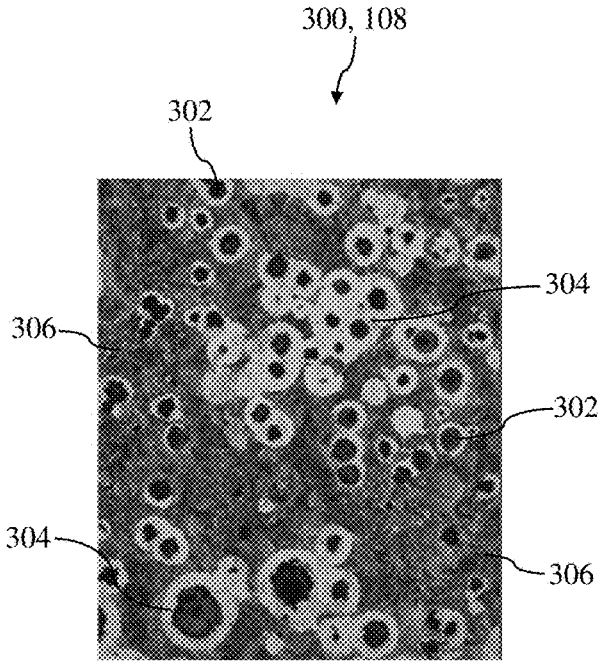
FIG. 7A Prior Art
FIG. 7A shows an enlarged view of a microstructure of a material prior to undergoing a microstructure alternation process, according to embodiments of the disclosure.
Figure 7B:
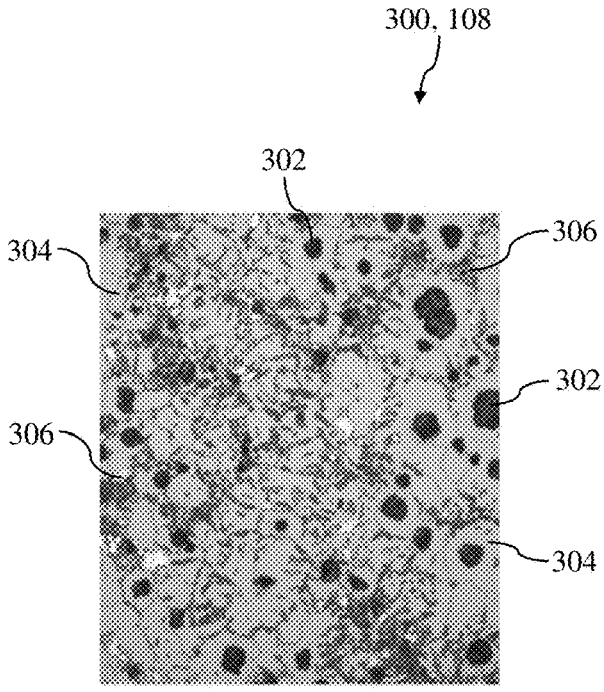
FIG. 7B shows an enlarged view of a microstructure of the material similar to FIG. 7A after undergoing a microstructure alternation process, according to embodiments of the disclosure.

FIGS. 7A and 7B show enlarged views of a microstructure of a material used to form component 108. More specifically, FIG. 7A shows an enlarged view of a microstructure of material 300 forming component 108 prior to undergoing a microstructure alternation process, as discussed herein. Additionally, FIG. 7B shows an enlarged view of the microstructure of material 300 forming component 108 after undergoing the microstructure alternation process, as discussed herein with respect to FIGS. 1-6. The scale of the microstructures of material 300 shown in FIGS. 7A and 7B may be approximately 50 microns (μm).

In the non-limiting example shown in FIGS. 7A and 7B, and as similarly discussed herein, material 300 forming component 108 may be iron (Fe) based material. As shown in FIG. 7A, material 300 may be formed and/or manufactured to include graphite 302 and a metal matrix of ferrite 304 and pearlite 306. That is, processes (e.g., casting) for forming component 108 from iron (Fe) based material 300 may result in the formation of graphite 302, ferrite 304, and pearlite 306 in the composition or microstructure of component 108. In the non-limiting example, material 300 forming component 108 may be substantially or mostly made up of pearlite 306. Additionally in the non-limiting example, ferrite 304 may be dispersed through material 300, and in most instances as shown in FIG. 7A, may substantially surround graphite 302 included therein. Ferrite 304 in material 300 may add and/or increase the ductility in material 300, while pearlite 306 in material 300 may improve and/or increase the strength and/or hardness in component 108.

Once formed, component 108 formed from material 300 may undergo a microstructure alteration process, as discussed herein with respect to FIG. 1-4. As shown in FIG. 7B, performing the processes discussed herein on component 108 may alter the microstructure of material 300 forming component 108. More specifically, and by comparison to the microstructure depicted in FIG. 7A, after performing the processes discussed herein, the microstructure of material 300 forming component 108 may be adjusted, changed, and/or altered. For example, the microstructure of material 300 shown in FIG. 7B may also include graphite 302, ferrite 304, and pearlite 306, but the ratio between ferrite 304 and pearlite 306 may be changed or altered. That is, performing the microstructure alternation process discussed herein on component 108 may result in the increase, creation, and/or generation of additional ferrite 304 within material 300 of component 108, and/or the reduction in the pearlite 306 within material 300. As such, the microstructure alternation process discussed herein and performed on component 108 may alter the ratio of materials present in the microstructure of the component—for example the ratio of ferrite 304 and pearlite 306 present in material 300 forming component 100. Additionally performing the microstructure alternation process discussed herein on component 108 may not (substantially) alter the amount of graphite 302 present in material 300. As a result, material 300 including graphite 302, ferrite 304, and pearlite 306 may include both ductile and strength characteristics—often two material characteristics or properties that are mutually exclusive. As discussed herein, the amount of graphite 302, ferrite 304, and pearlite 306 generated in component 108 may be controlled and/or dependent on the predetermined number of cycles, time of each cycle, electromagnetic strength, and/or predetermined temperature 212 of component 108.

Figure 8:
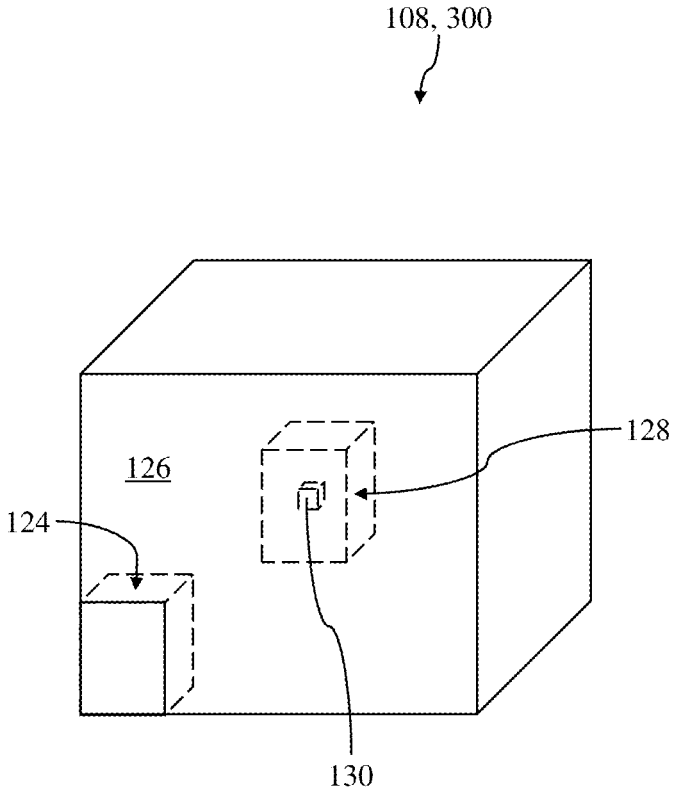
FIG. 8 shows a perspective view of a component formed from a material having undergone a microstructure alternation process, according to embodiments of the disclosure.

Turning to FIG. 8, a non-limiting example of component 108 is shown. In addition to controlling and/or adjusting the amount of graphite 302, ferrite 304, and pearlite 306 by performing the processes discussed herein, the processes may also ensure uniform distribution of graphite 302, ferrite 304, and pearlite 306 within material 300 forming component 108. For example, the process of applying the electromagnetic field to component 108 heated to predetermined temperature 212 (see, FIGS. 1-4), may ensure that the changes and/or alternations to the microstructure of material 300 forming component 108 happens uniformly throughout component 108. That is, the inclusion of applying the electromagnetic field may reduce or eliminate microstructure and/or compositional discrepancies between, for example, an outer portion 124 of component 108 formed adjacent an outer surface 126 and an inner portion 128 positioned adjacent a core 130. As such, the compositional percentage of graphite 302, ferrite 304, and pearlite 306 within material 300 (see, FIG. 7B) forming component 108 may be substantially uniform throughout component 108.

Figure 9:
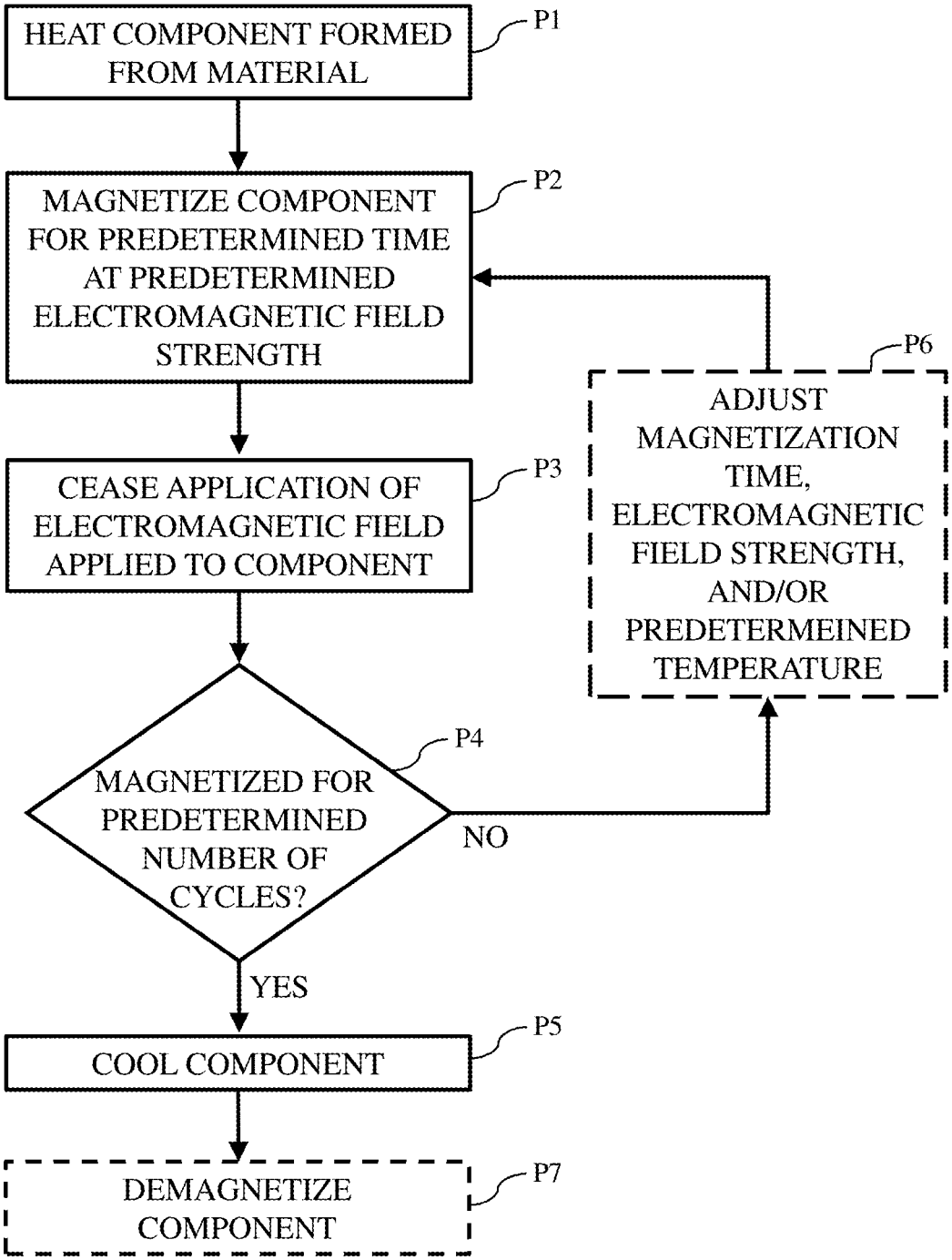
FIG. 9 shows a flow chart of an example process for altering a microstructure of a component, according to embodiments of the disclosure.

FIG. 9 shows a flow diagram illustrating non-limiting example processes of altering a microstructure of a material that may be used to form a component. These processes may be performed, e.g., by at least one computing device 120 including control system 122 (see, FIG. 1), as described herein. In other cases, these processes may be performed according to a computer-implemented method of controlling system 100 including apparatus 102 (see, FIG. 1). In still other embodiments, these processes may be performed by executing computer program code on computing device(s) 120, causing computing device(s) 120, and specifically control system 122, to control operation of system 100 and/or apparatus 102.

In process P1, a component formed from a material may be heated. More specifically, the component may be heated to a predetermined temperature based on properties and/or characteristics of the material forming the component. Additionally, heating the component to the predetermined temperature may be dependent on a predetermined phase field for the material. That is, the predetermined temperature in which the component may be heated may be associated with and/or may place the material forming the component in a first phase field. The predetermined temperature may also be below a first phase-transformation temperature that may be dependent or based on the material forming the component. The first phase-transformation temperature may at least partially define a second phase field of the material, and/or may separate the first phase field and the second phase field of the material. Additionally, the predetermined temperature may also be below a second phase-transformation temperature that may be dependent or based on the material forming the component. The second phase-transformation temperature may be greater than the first phase-transformation temperature and may at least partially define a third phase field of the material, and/or may separate the second phase field and the third phase field of the material. Once heated to the predetermined temperature, the component may be maintained at that temperature when performing additional processes on the component. That is, the component may be maintained at the predetermined temperature while performing processes P2-P5, as discussed herein.

In process P2, the heated component may be magnetized. More specifically, the component heated to the predetermined temperature may be magnetized by applying an electromagnetic field. The electromagnetic field may be applied to the component for a predetermined time and at a predetermined electromagnetic strength for each of a predetermined number of cycles, as discussed herein with respect to process P2-P5. The predetermined time for applying the electromagnetic field and/or the predetermined electromagnetic strength for applying the electromagnetic field may be based and/or dependent on the material forming the component. That is, the predetermined electromagnetic application time and/or predetermined electromagnetic strength may be dependent on the material forming the component to ensure the material changes phase fields, as discussed herein. In response to magnetizing and/or applying the electromagnetic field to the component, the first phase-transformation temperature may be reduced. More specifically, when the electromagnetic field is applied to the heated component, the first phase-transformation temperature based on the material forming the component may be reduced and/or lowered from its de-magnetized and/or heated status. As a result of lowering or reducing the first phase-transformation temperature, the maintained, predetermined temperature of the component may be greater than the reduced, first phase-transformation temperature when applying the electromagnetic field to the component. Additionally, the material forming the component, heated to and maintained at the predetermined temperature, may also shift from the first phase field to the second phase field defined by the reduced, first phase-transformation temperature. Specifically, as result of reducing the first phase-transformation temperature and maintaining the component at the predetermined temperature, the material forming the component may be shifted from the first phase field to the second phase field while the electromagnetic field is applied. The amount or change in the reduced, first phase-transformation temperature may be dependent, at least in part, on the predetermined time and/or the predetermined electromagnetic strength of the applied electromagnetic field.

In addition to reducing the first phase-transformation temperature, the second phase-transformation temperature may also be reduced in response to magnetizing and/or applying the electromagnetic field to the component in process P2. More specifically, when the electromagnetic field is applied to the heated component, the second phase-transformation temperature based on the material forming the component may be reduced and/or lowered from its de-magnetized and/or heated status. In a non-limiting example, where the predetermined temperature of the component is greater than the reduced, first phase-transformation temperature, the predetermined temperature of the component may still be lower or less than the reduced, second phase-transformation temperature. In another non-limiting example, the maintained, predetermined temperature of the component may be greater than both the reduced, first phase-transformation temperature and the reduced, second phase-transformation temperature when applying the electromagnetic field to the component. In the non-limiting example, the material forming the component, heated to and maintained at the predetermined temperature, may also shift from the first phase field to the third phase field defined by the reduced, second phase-transformation temperature. Specifically, as result of reducing the second phase-transformation temperature and maintaining the component at the predetermined temperature, the material forming the component may be shifted from the first phase field to the third phase field while the electromagnetic field is applied.

In process P3, the application of the electromagnetic field may be ceased. More specifically, the electromagnetic field applied to the component in process P2 may cease, stopped or may not be applied to the component heated and maintained at the predetermined temperature. As a result of ceasing and/or discontinuing the application of the electromagnetic field to the heated component, the first phase-transformation temperature may be returned to its initial temperature, position, and/or status. That is, once the component is no longer being exposed to the electromagnetic field, the first phase-transformation temperature may increase and/or be returned from the reduced, first phase-transformation temperature, resulting from the application of the electromagnetic field, to the first phase-transformation temperature for the material forming the component. The (returned) first phase-transformation temperature may be the same as that predetermined in process P1 based on the material forming the component.

In process P4, it may be determined if the component was magnetized for a predetermined number of cycles. More specifically, it may be determined if the component heated to and maintained at the predetermined temperature was intermittently magnetized (e.g., magnetized in P2 and demagnetized in P3) for a predetermined number of cycles. Similar to the predetermined time and the predetermined electromagnetic field strength, the predetermined number of cycles in which the component is intermittently magnetized may be dependent or based on the material forming the component.

In response to determining that the component has been intermittently magnetized (e.g., processes P2 and P3) for the predetermined number of cycles (e.g., "YES" at process P4), the component may be cooled in process P5. More specifically, in process P5 the component maintained at the predetermined temperature may be cooled and/or may no longer be heated to and/or maintained at the predetermined temperature. In a non-limiting example, the component may be cooled by discontinuing the heat applied to the component, such that the component reduces to a desired temperature (e.g., room temperature) by a natural process and/or without additional aid. In other non-limiting examples, the component may be cooled using additional aids and/or processes. For example, the component may be submerged in a cooling bath or may be sprayed with nitrogen to rapidly cool and/or decrease the temperature of the component. Cooling the component may also include reducing the temperature of the component from the predetermined temperature to a desired temperature. The desired cooling temperature may be predetermined and/or based on post or additional processes that may be performed on the component undergoing processes P1-P4 (and P6), and/or may be dependent on the function, operation, and/or intended use of the component.

In response to determining that the component has not been intermittently magnetized (e.g., processes P2 and P3) for the predetermined number of cycles (e.g., "NO" at process P4), processes P2-P4 may be performed at least one additional time until it is determined that the component has been intermittently magnetized for the predetermined number of cycles (e.g., "YES" at process P4). In each additional cycle, the component may be magnetized for the same predetermined period and/or with the same predetermined electromagnetic strength as the previous cycle.

In another non-limiting, the predetermined time, the predetermined electromagnetic strength, and/or the predetermined temperature for the component may be adjusted in process P6. That is, in response to determining that the component has not been intermittently magnetized (e.g., processes P2 and P3) for the predetermined number of cycles (e.g., "NO" at process P4), process P6 (shown in phantom as optional) may be performed prior to performing processes P2-P4 at least one additional time. In optional process P6, the predetermined time for applying the electromagnetic field to the component, the predetermined electromagnetic strength of the electromagnetic field applied to the component, and/or the predetermined temperature in which the component is heated may be adjusted (e.g., increased/decreased) prior to magnetizing the component again in process P2. The predetermined time, the predetermined electromagnetic strength and/or the predetermined temperature may be adjusted each cycle of intermittently magnetizing the component, or alternatively, may only be adjusted once (e.g., a final cycle).

In process P7 (shown in phantom as optional), the component may be demagnetized. More specifically, and subsequently to determining that the component has been intermittently magnetized (e.g., processes P2 and P3) for the predetermined number of cycles (e.g., "YES" at process P4) and/or the component is cooled (e.g., P5), the component may be demagnetized and/or may have the magnetic field altered or removed. The component may gain and/or inherit a magnetic field as a result of intermittently magnetizing the component as discussed herein with respect to processes P2-P4 (and P6). Demagnetizing the component may remove and/or alter the gained magnetic field and/or polarization of the component. The component may be demagnetized in process P7 using any suitable device and/or system that may apply a different/reverse polarized magnitude to the component and/or remove the magnetic field from the component.

It is to be understood that in the flow diagrams shown and described herein, other processes or operations, while not being shown, may be performed. The order of processes may also be rearranged according to various embodiments. For example, although shown as being performed in succession, processes P3 and P4 and/or processes P5 and P7 may be performed simultaneously. Additionally, intermediate processes may be performed between one or more described processes. The flow of processes shown and described herein is not to be construed as being limited to the various embodiments.

Figure 10:
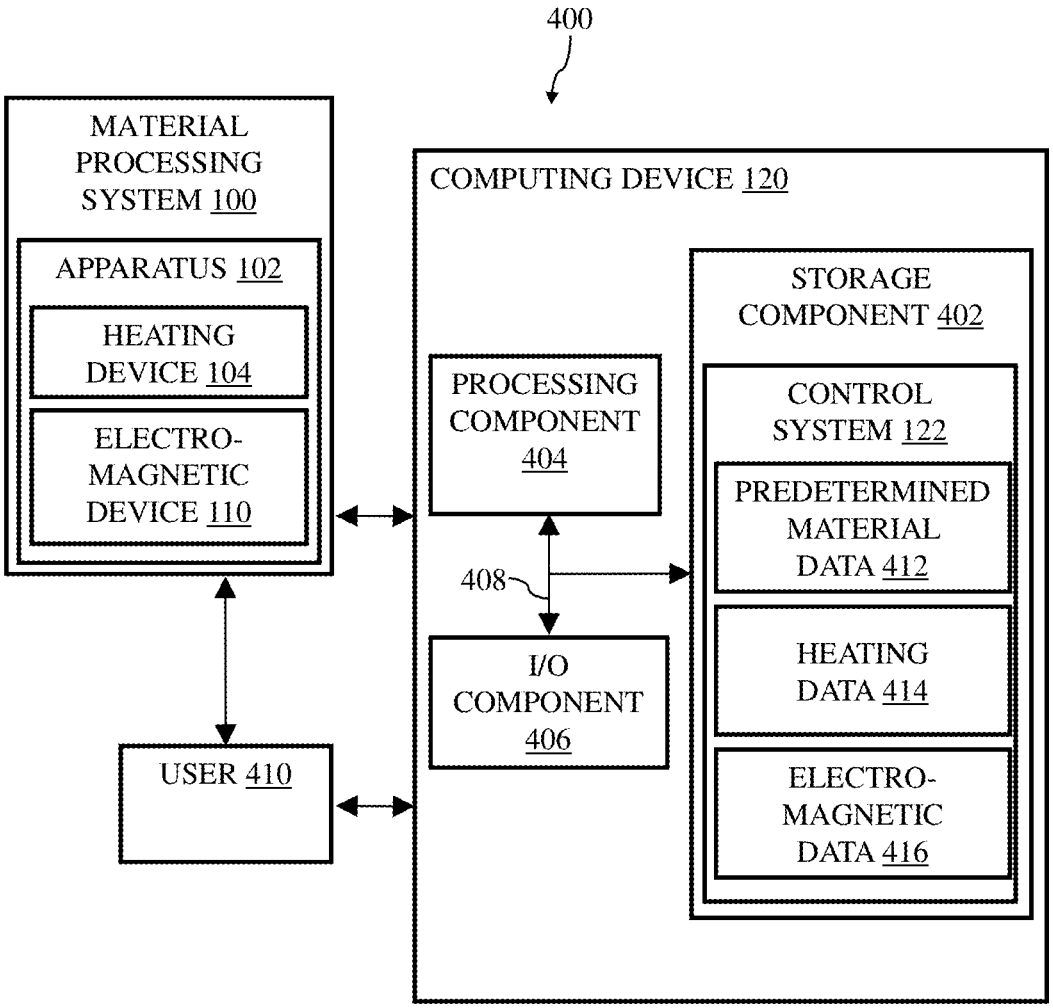
FIG. 10 shows an environment including at least one computing device for altering a microstructure of a component using an apparatus of a material processing system as shown in FIG. 1, according to embodiments of the disclosure.

FIG. 10 shows an illustrative environment 400. To this extent, environment 400 includes at least one computing device(s) 120 that can perform the various process steps described herein for altering a microstructure of a material forming component 108 using apparatus 102 of material processing system 100. In particular, computing device(s) 120 is shown including control system 122, which enable computing device 120 to control operation of system 100, as well as alter the microstructure of the material forming component 108 by performing one or more of the process steps of the disclosure.

Computing device 120 is shown including a storage component 402, a processing component 404, an input/output (I/O) component 406, and a bus 408. Further, computing device 120 is shown in communication with system 100 and a user 410. As is known in the art, in general, processing component 404 executes computer program code, such as control system 122, that is stored in storage component 402 or an external storage component (not shown). While executing computer program code, processing component 404 may read and/or write data, such predetermined material data 412, heating data 414, and/or electromagnetic data 416, to/from storage component 402 and/or I/O component 406. Bus 408 provides a communications link between each of the components in computing device 120. I/O component 406 may comprise any device that enables user 410 to interact with computing device 120 or any device that enables computing device 120 to communicate with one or more other computing devices. Input/output devices (including but not limited to keyboards, displays, pointing devices, etc.) may be coupled to the system either directly or through intervening I/O controllers.

In any event, computing device 120 may comprise any general purpose computing article of manufacture capable of executing computer program code installed by a user 410 (e.g., a personal computer, server, handheld device, etc.). However, it is understood that computing device 120 and control system 122 are only representative of various possible equivalent computing devices that may perform the various process steps of the disclosure. To this extent, in other embodiments, computing device 120 may comprise any specific purpose computing article of manufacture comprising hardware and/or computer program code for performing specific functions, any computing article of manufacture that comprises a combination of specific purpose and general purpose hardware/software, or the like. In each case, the program code and hardware may be created using standard programming and engineering techniques, respectively.

Similarly, computing device 120 is only illustrative of various types of computer infrastructures for implementing the disclosure. For example, in one embodiment, computing device 120 may include two or more computing devices (e.g., a server cluster) that communicate over any type of wired and/or wireless communications link, such as a network, a shared memory, or the like, to perform the various process steps of the disclosure. When the communications link comprises a network, the network may comprise any combination of one or more types of networks (e.g., the Internet, a wide area network, a local area network, a virtual private network, etc.). Network adapters may also be coupled to the system to enable the data processing system to become coupled to other data processing systems or remote printers or storage devices through intervening private or public networks. Modems, cable modem and Ethernet cards are just a few of the currently available types of network adapters. Regardless, communications between the computing devices may utilize any combination of various types of transmission techniques.

As previously mentioned and discussed herein, control system 118 enables computing device 120 to alter a microstructure of a material forming component 108 using apparatus 102 of system 100. To this extent, control system 122 is shown including predetermined material data 412, heating data 414, and/or electromagnetic data 416 that may be utilized in the material altering process. Operation of this data is discussed further herein. However, it is to be understood that some of the data shown in FIG. 10 may be implemented independently, combined, and/or stored in memory for one or more separate computing devices that are included in computing device 120. Further, it is to be understood that some of the data and/or functionality may not be implemented, or additional data and/or functionality may be included as part of environment 100.

The flowchart and block diagrams in the figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, may be implemented by special purpose hardware-based systems that perform the specified functions or acts, or combinations of special purpose hardware and computer instructions.

As discussed herein, various systems and components are described as "obtaining" data. It is understood that the corresponding data can be obtained using any solution. For example, the corresponding system/component can generate and/or be used to generate the data, retrieve the data from one or more data stores (e.g., a database), receive the data from another system/component, and/or the like. When the data is not generated by the particular system/component, it is understood that another system/component can be implemented apart from the system/component shown, which generates the data and provides it to the system/component and/or stores the data for access by the system/component.

As will be appreciated by one skilled in the art, the present disclosure may be embodied as a system, method or computer program product. Accordingly, the present disclosure may take the form of an entirely hardware embodiment, an entirely software embodiment (including firmware, resident software, micro-code, etc.) or an embodiment combining software and hardware aspects that may all generally be referred to herein as a "circuit," "module" or "system." Furthermore, the present disclosure may take the form of a computer program product embodied in any tangible medium of expression having computer-usable program code embodied in the medium.

Any combination of one or more computer usable or computer readable medium(s) may be utilized. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

The present disclosure is described herein with reference to flowchart illustrations and/or block diagrams of methods, apparatus (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Technical effects of the disclosure include, e.g., providing a systems, computer program products, and methods for quickly and effectively testing control circuits included within power circuits for large systems. The system, computer program product, and methods may also provide output regarding specific, detected abnormalities in the control circuits and details relating to how to correct or fix these detected abnormalities.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims herein are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A system, comprising:

at least one computing device in communication with a heating device and an electromagnetic device, the at least one computing device configured to alter a microstructure of a material forming a component by performing processes including:

heating the component using the heating device to a predetermined temperature within a first phase field of the material, maintaining the temperature of the component at the predetermined temperature, wherein the predetermined temperature is below:

a first phase-transformation temperature based on the material forming the component, the first phase-transformation temperature defining a transition to a second phase field of the material, distinct from the first phase field, and a second phase-transformation temperature based on the material forming the component, the second phase-transformation temperature greater than the first phase-transformation temperature and defining a transition to a third phase field of the material, distinct from the first phase field and the second phase field, intermittently magnetizing the heated component using the electromagnetic device for a predetermined number of cycles of an electromagnetic field while maintaining the temperature of the component at the predetermined temperature; cooling the component after intermittently magnetizing the heated component; and demagnetizing the component after intermittently magnetizing for the predetermined number of cycles of the electromagnetic field, wherein the demagnetizing includes at least one of:

demagnetizing the component during cooling of the component; and demagnetizing the component after cooling of the component.

2. The system of claim 1, wherein the at least one computing device is configured to intermittently magnetize the heated component by performing processes including:

applying the electromagnetic field to the component for a predetermined time and at a predetermined electromagnetic strength for each of the predetermined number of cycles, wherein the predetermined number of cycles, the predetermined time, and the predetermined electromagnetic strength are based on the material forming the component.

3. The system of claim 2, wherein the processes performed by the at least one computing device to alter the microstructure of the material forming the component further include:

reducing the first phase-transformation temperature based on the material forming the component when applying the electromagnetic field to the component, the reduced, first phase-transformation temperature defining the second phase field of the material; and returning the first phase-transformation temperature from the reduced, first phase-transformation temperature to the first phase-transformation temperature when discontinuing the application of the electromagnetic field to the component.

4. The system of claim 3, wherein the predetermined temperature of the component is greater than the reduced, first phase-transformation temperature when applying the electromagnetic field to the component.

5. The system of claim 4, wherein the processes performed by the at least one computing device to alter the microstructure of the material forming the component further include:

shifting the material forming the component from the first phase field to the second phase field defined by the reduced, first phase-transformation temperature when applying the electromagnetic field to the component.

6. The system of claim 3, wherein the processes performed by the at least one computing device to alter the microstructure of the material forming the component further include:

reducing the second phase-transformation temperature based on the material forming the component while applying the electromagnetic field to the component, the reduced, second phase-transformation temperature defining the third phase field of the material; and returning the second phase-transformation temperature from the reduced, second phase-transformation temperature to the second phase-transformation temperature when discontinuing the application of the electromagnetic field to the component.

7. The system of claim 6, wherein the second, phase-transformation temperature of the component is greater than the reduced, second phase-transformation temperature when applying the electromagnetic field to the component.

8. The system of claim 7, wherein the processes performed by the at least one computing device to alter the microstructure of the material forming the component further include:

shifting the material forming the component from the first phase field to the third phase field defined by the reduced, second phase-transformation temperature when applying the electromagnetic field to the component.

9. The system of claim 1, wherein the electromagnetic device substantially surrounds and is separated from the heating device.

10. The system of claim 9, further comprising a heat shield positioned between the electromagnetic device and the heating device.

11. A method of altering a microstructure of a material forming a component, the method comprising:

heating the component using a heating device to a predetermined temperature within a first phase field of the material, maintaining the temperature of the component at the predetermined temperature, wherein the predetermined temperature is below:

a first phase-transformation temperature based on the material forming the component, the first phase-transformation temperature defining a second phase field of the material, distinct from the first phase field, and a second phase-transformation temperature based on the material forming the component, the second phase-transformation temperature greater than the first phase-transformation temperature and defining a third phase field of the material, distinct from the first phase field and the second phase field, intermittently magnetizing the heated component using an electromagnetic device for a predetermined number of cycles of an electromagnetic field while maintaining the temperature of the component at the predetermined temperature; cooling the component after intermittently magnetizing the heated component; and demagnetizing the component after intermittently magnetizing for the predetermined number of cycles of the electromagnetic field, wherein the demagnetizing includes at least one of:

demagnetizing the component during cooling of the component; and demagnetizing the component after cooling of the component.

12. The method of claim 11, wherein intermittently magnetizing the heated component further includes:

applying the electromagnetic field to the component for a predetermined time and at a predetermined electromagnetic strength for each of the predetermined number of cycles, wherein the predetermined number of cycles, the predetermined time, and the predetermined electromagnetic strength are based on the material forming the component.

13. The method of claim 12, further comprising:

reducing the first phase-transformation temperature based on the material forming the component when applying the electromagnetic field to the component, the reduced, first phase-transformation temperature defining the second phase field of the material; and returning the first phase-transformation temperature from the reduced, first phase-transformation temperature to the first phase-transformation temperature when discontinuing the application of the electromagnetic field to the component.

14. The method of claim 13, wherein the predetermined temperature of the component is greater than the reduced, first phase-transformation temperature when applying the electromagnetic field to the component.

15. The method of claim 12, further comprising:

shifting the material forming the component from the first phase field to the second phase field defined by the reduced, first phase-transformation temperature when applying the electromagnetic field to the component.

16. The method of claim 12, further comprising:

reducing the second phase-transformation temperature based on the material forming the component while applying the electromagnetic field to the component, the reduced, second phase-transformation temperature defining the third phase field of the material; and returning the second phase-transformation temperature from the reduced, second phase-transformation temperature to the second phase-transformation temperature when discontinuing the application of the electromagnetic field to the component.

17. The method of claim 16, further comprising:

shifting the material forming the component from the first phase field to the third phase field defined by the reduced, second phase-transformation temperature when applying the electromagnetic field to the component, wherein the maintained, predetermined temperature of the component is greater than the reduced, second phase-transformation temperature when applying the electromagnetic field to the component.

* * * * *